US007618501B2

(12) United States Patent
Gartz

(10) Patent No.: US 7,618,501 B2
(45) Date of Patent: Nov. 17, 2009

(54) METHOD FOR THE HEAT TREATMENT OF EXTENDED STEEL PRODUCTS

(75) Inventor: Mats Gartz, Sollentuna (SE)

(73) Assignee: AGA AB, Lidingo (SE)

( * ) Notice: Subject to any disclaimer, the term of this patent is extended or adjusted under 35 U.S.C. 154(b) by 333 days.

(21) Appl. No.: 11/712,895

(22) Filed: Mar. 2, 2007

(65) Prior Publication Data

US 2008/0178970 A1 Jul. 31, 2008

(30) Foreign Application Priority Data

Jan. 29, 2007 (SE) ..... 0700203

(51) Int. Cl.
*C21D 9/08* (2006.01)

(52) U.S. Cl. ..... 148/511; 148/648

(58) Field of Classification Search ..... 148/511, 148/648

See application file for complete search history.

(56) References Cited

U.S. PATENT DOCUMENTS

| | | | | |
|---|---|---|---|---|
| 3,291,465 A | | 12/1966 | Wilde | |
| 3,409,217 A | * | 11/1968 | Gentry | 236/15 R |
| 4,373,706 A | | 2/1983 | Elhaus et al. | |
| 4,889,483 A | | 12/1989 | Gentry | |

FOREIGN PATENT DOCUMENTS

| | | | |
|---|---|---|---|
| EP | 0 760 397 | | 3/1997 |
| JP | 09019710 A | * | 1/1997 |
| JP | 2002-239601 | | 8/2002 |
| WO | 03/070992 | | 8/2003 |
| WO | WO 03/070992 | | 8/2003 |
| WO | WO 2006/008169 | | 1/2006 |
| WO | 2006/088169 | | 8/2006 |

OTHER PUBLICATIONS

International Preliminary Report on Patentability, dated Apr. 23, 2009 and issued in corresponding International Patent Application No. PCT/SE2007/051029.

* cited by examiner

*Primary Examiner*—Scott Kastler
(74) *Attorney, Agent, or Firm*—Young & Thompson

(57) ABSTRACT

A method for the heat treatment of extended steel products such as, for example, rods, pipes, work pieces, etc., while the products are in motion. The products (13, 14, 33, 34, 35) are caused to be heated by DFI burners (6-11, 16-20) (where "DFI" is an abbreviation for "direct flame impingement"), which burners are caused to be located such that one set of burners (6, 7, 8, 9, 10, 11), (16, 17, 18, 19, 20) essentially covers the circumference of the products, and in the burners are caused to be located integrated into arrangements (2-4, 13) that transport the product in a direction that is perpendicular to a plane in which the flames of the burners essentially lie.

12 Claims, 2 Drawing Sheets

METHOD FOR THE HEAT TREATMENT OF EXTENDED STEEL PRODUCTS

The present invention relates to a method for the heat treatment of extended steel products.

During the processing of steel products, the mechanical, metallurgical and surface chemical properties of the material are changed. It may be necessary to change these properties before further use and/or processing. Heating followed by cooling is one method of changing the properties of a material.

A material is heated to a processing temperature, for example 1150° C. for the rolling of work pieces to rods, wires or tubes, before processing of the material. The material is cooled after the processing operation on a cooling bed or similar. The heat that is supplied to the material in order to be able to carry out the heat processing is sometimes recovered through heat exchangers, but it is in most cases lost.

The classes of a material that are to undergo cold processing must be heat treated in most cases in order to obtain material properties that are suitable for cold processing. The material is heated as rapidly as possible to a holding temperature during this heat treatment, and it subsequently undergoes a slow and controlled cooling to room temperature, or it may undergo repeated cooling and heating, i.e. cyclic heat treatment, with a subsequent cooling to room temperature.

In those cases in which heat treatment is to be carried out as the process that immediately follows heat processing, it is desirable that remaining heat after the heat processing step can be used in order to increase the temperature rapidly.

One problem during the rolling of a product is that extended products do not always have an even temperature along their entire length. The ends of the product, for example, may have another temperature than that of the rest of the product. This affects the product during rolling. There is, therefore, a need to be able to heat rapidly the ends, for example, of the product.

A second problem is that products are often cooled after rolling to a temperature lower than, for example, 720° C., whereby the surface of the material is converted, after which the surface of the material is heated in order to achieve recrystallisation. The internal heat of the material is not sufficient for this. Thus it would here be desirable to heat the surface rapidly, whereby the internal heat of the material would be conserved.

The present method solves the problems described above, and offers an efficient way of rapidly increasing the temperature of extended products.

The present invention thus relates to a method for the heat treatment of extended steel products such as rods, tubes, work pieces, etc., while the products are in motion, and it is characterised in that the products are caused to be heated by means of DFI burners (where "DFI" is an abbreviation of "direct flame impingement"), which burners have been caused to be located such that one set of burners essentially covers the circumference of the products and in that the burners are caused to be located integrated into arrangements that transport the product in a direction perpendicular to a plane in which the flames of the burners essentially lie.

The invention will be described in more detail below, partially with reference to embodiments of the invention shown in the attached drawings, where:

The present invention concerns a method for the heat treatment of extended steel products, such as rods, pipes, work pieces, etc. The term "heat treatment" is used to denote conventional heat treatment, and also to denote the heating of a product in order to raise or adjust its temperature.

The heat treatment is carried out while the products are in motion.

The products are caused to be heated, according to the invention, by means of DFI burners (where "DFI" is an abbreviation for "direct flame impingement"), which are caused to be located such that one set of burners essentially covers the circumference of the products. Furthermore, the burners are caused to be located integrated into arrangements that transport the product in a direction that is perpendicular to a plane in which the flames of the burners essentially lie.

According to one preferred embodiment, the fuel of the burners is caused to be liquid or gaseous, and in that a gas that contains at least 80% by volume of oxygen gas is caused to be the oxidant.

Figure 1:
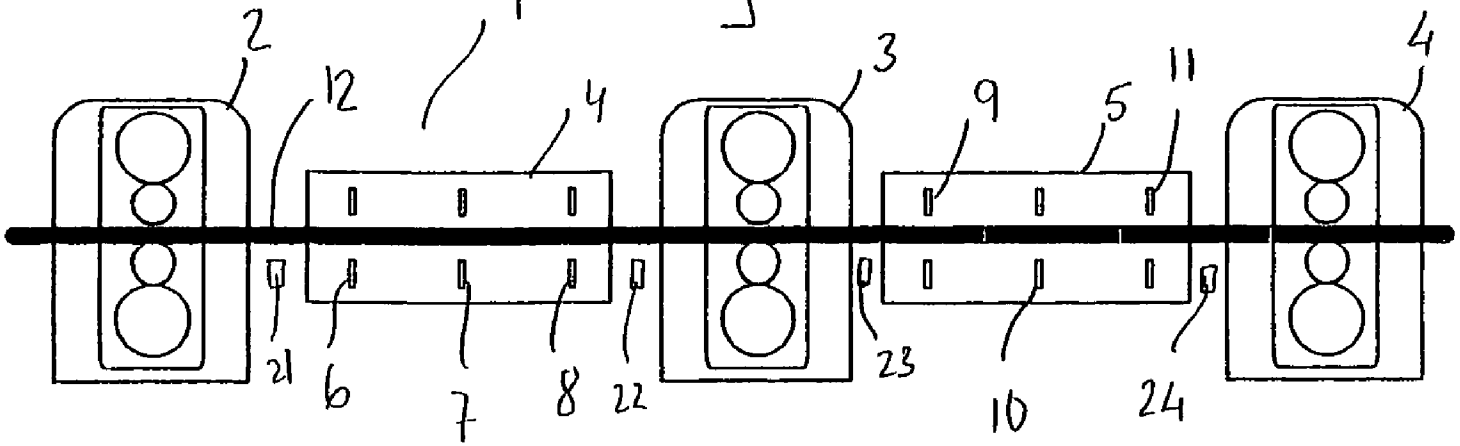
FIG. 1 shows a rolling line with three pairs of rollers.

FIG. 1 shows a rolling line 1 comprising three pairs 2, 3, 4 of rollers. The pairs of rollers may be reversible. An arrangement 4, 5 is placed between the pairs of rollers, each such arrangement having three sets 6, 7, 8, 9, 10, 11 of burners. When the product 12 is transported through the rolling line, the product can thus be heated by means of one, two or more sets of burners. For example, at least one of the front and the back of the product, or the complete product, can be heated as necessary.

The heat that is supplied in order to be able to heat process the material by, for example, rolling, is optimally used in that the residual heat is conserved during direct heat treatment.

Figure 2:
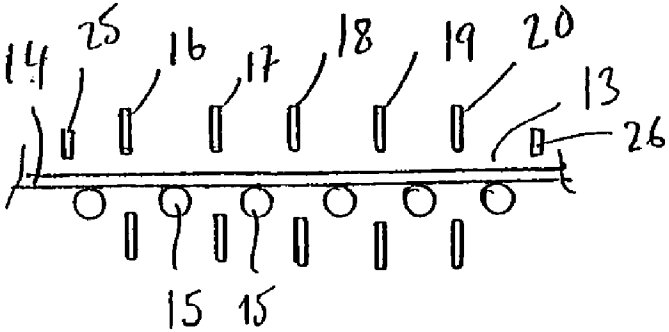
FIG. 2 shows a part of a roller band.

FIG. 2 shows a cross-section of a roller band 13 for the transport of a product 14. The roller band comprises in a conventional manner a number of driven rollers 15. Sets of burners 16-20 are located between the rollers 15 for the heating of the complete product 14 or of parts of it.

Figure 5:
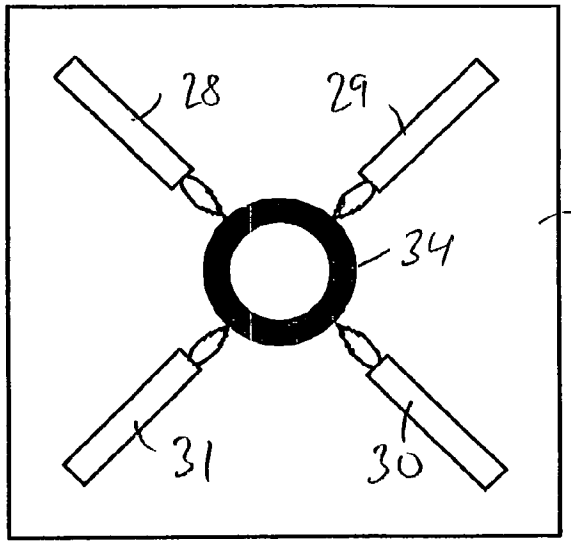
FIGS. 4 to 6 show cross-sections of different products.
Figure 6:
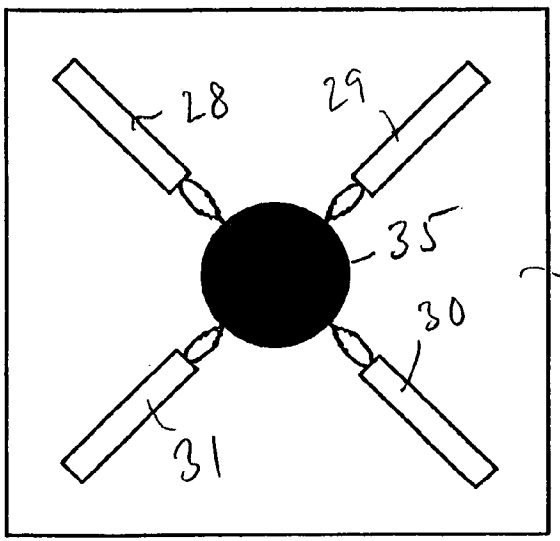
Figure 4:
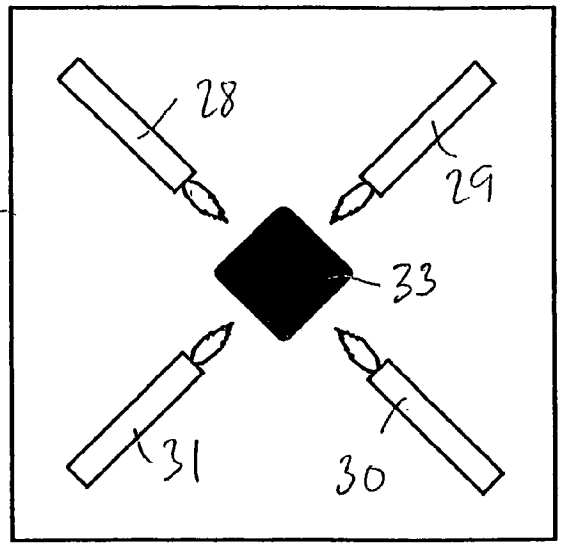

FIGS. 4 to 6 illustrate the sets of burners and cross-sections of different products. Four burners, 28-31, for example, are located in each set of burners. The burners are supported by a suitable frame 32. The number 33 in the drawings denotes a rectangular work piece, the number 34 denotes a pipe, and the number 35 denotes a rod.

The sets of burners with DFI burners require little space and can easily be built into roller bands. The heating process becomes in this way compact and efficient.

The holding furnace, furthermore, can be built relatively small since only small power is required to maintain the heat in the material.

According to one preferred embodiment, temperature sensors 21-24, 25, 26 are located along the transport pathway of the product, which sensors are caused to determine the temperature of a product that passes a temperature sensor.

Figure 3:
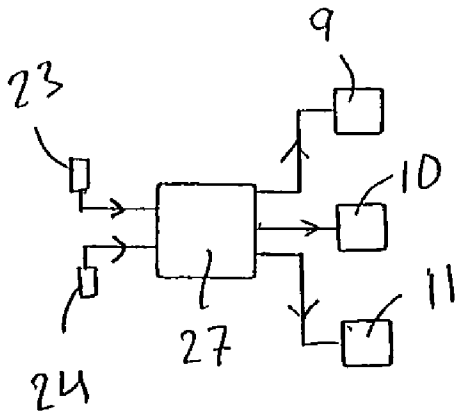
FIG. 3 shows a block diagram.

According to a second preferred embodiment, a control circuit 27 is available for each set of burners, which control circuit is caused to control the burners depending on the temperature of the product that has been determined by one or more of the temperature sensors. This is illustrated in FIG. 3 with respect to the sets of burners 9, 10, 11 and the temperature sensors 23, 24.

The temperature sensors may be of any suitable type, where suitable sensors may be infrared (IR) sensors.

For example, the product in the form of a steel material can be brought to the roller band 13 after a hot-rolling process. The heat of the rolling is used, and the temperature of the material is raised to a holding temperature through the product passing the sets of burners that heat the material directly. Once the holding temperature has been reached, the material enters a holding furnace in which it is held and allowed to cool as specified in the protocol for the material.

The material can achieve the correct material properties through cyclic heating, where this is appropriate. The material is in this case heated from the cooling bed temperature to a first holding temperature with the aid of sets of burners, cooled to the temperature required, rapidly heated with the aid of sets of burners to a second holding temperature, cooled, etc., in order finally to cool to room temperature as specified in the protocol.

Since cooling on a cooling bed and conventional slow heating in a bundle can be avoided, both the formation of oxide scale and decarburisation are radically reduced, which improves yield and quality.

The even distribution of the supplied energy along the circumference of the extended steel surface is ensured by passing the material through a number of sets of burners. The heating is rapid, and each extended product is heat-treated individually, in contrast to the method used today in which everything is heat-treated in bundles, which gives differences in the properties of the material, depending on the location at which the material has laid within the bundle.

It is most often the case with current heat treatment methods that the material must be divided into even multiple lengths in order for it to be possible to heat-treat simply and evenly the material in bundles. The use of direct heating ensures that the heating in a holding furnace can deal with a mixture of different lengths of material. This entails an increased yield not only in the rolling process but also in subsequent processes.

A number of embodiments have been described above. It is, however, obvious for one skilled in the arts that the number of burners can be varied, as can their locations relative to the product, and the locations of the temperature sensors.

Thus, the present invention is not to be seen as limited to the embodiments described above: it can be varied within the framework specified by the attached patent claims.

I claim:

1. A method for the heat treatment of extended steel products while the steel products are being transported, the method comprising:

providing a rolling line having at least two rolling stations, each of the rolling stations having a plurality of rollers for transporting the steel products along the rolling line in a direction of travel between the at least two rolling stations;

providing at least one set of direct flame impingement (DFI) burners along the rolling line between the rolling stations, the DFI burners being arranged so that flames of the DFI burners lie essentially in a plane that is perpendicular to the direction of travel, and so that the set of DFI burners essentially covers a circumference of the steel products as the steel products are transported between the rolling stations;

using the rolling line to move the steel products along the direction of travel; and using the set of DFI burners to heat the steel products directly while the steel products are being moved by the rolling line between the rolling stations;

wherein the set of burners is supplied with a fuel that is one of liquid and gaseous; and wherein the set of burners is supplied with an oxidant that comprises at least 80% by volume oxygen gas.

2. The method of claim 1, wherein the at least one set of DFI burners comprises at least two said sets arranged along the rolling line between the rolling stations.

3. The method of claim 1, wherein the set of DFI burners are constructed and arranged and the heating step is performed so as to heat the steel products to different degrees along a length of said products.

4. The method of claim 2, wherein at least two sets of DFI burners are constructed and arranged and the heating step is performed so as to heat the steel products to different degrees along a length of said products.

5. The method of claim 1, further comprising steps of:

providing temperature sensors along the rolling line; and using the temperature sensors to measure a temperature of the steel products as the steel products pass said sensor.

6. The method of claim 2, further comprising steps of:

providing temperature sensors along the rolling line; and using the temperature sensors to measure a temperature of the steel products as the steel products pass said sensor.

7. The method of claim 3, further comprising steps of:

providing temperature sensors along the rolling line; and using the temperature sensors to measure a temperature of the steel products as the steel products pass said sensor.

8. The method of claim 4, further comprising steps of:

providing temperature sensors along the rolling line; and using the temperature sensors to measure a temperature of the steel products as the steel products pass said sensor.

9. The method of claim 5, further comprising steps of:

providing a control circuit associated with each said set of burners, each said control circuit being constructed and arranged to control an associated said set of burners based on the temperature measurements provided by at least one of the temperature sensors.

10. The method of claim 6, further comprising steps of:

providing a control circuit associated with each said set of burners, each said control circuit being constructed and arranged to control an associated said set of burners based on the temperature measurements provided by at least one of the temperature sensors.

11. The method of claim 7, further comprising steps of:

providing a control circuit associated with each said set of burners, each said control circuit being constructed and arranged to control an associated said set of burners based on the temperature measurements provided by at least one of the temperature sensors.

12. The method of claim 8, further comprising steps of:

providing a control circuit associated with each said set of burners, each said control circuit being constructed and arranged to control an associated said set of burners based on the temperature measurements provided by at least one of the temperature sensors.

* * * * *